US012090548B2

(12) United States Patent
Whealy et al.

(10) Patent No.: US 12,090,548 B2
(45) Date of Patent: Sep. 17, 2024

(54) DIE LOCKING SYSTEM AND METHODS OF USING THE SAME

(71) Applicant: DELAWARE DYNAMICS LLC, Cleveland, OH (US)

(72) Inventors: Gregg E. Whealy, Losantville, IN (US); Ryan A. Haas, Fishers, IN (US)

(73) Assignee: Delaware Dynamics LLC, Cleveland, OH (US)

( * ) Notice: Subject to any disclaimer, the term of this patent is extended or adjusted under 35 U.S.C. 154(b) by 0 days.

(21) Appl. No.: 17/506,282

(22) Filed: Oct. 20, 2021

(65) Prior Publication Data

US 2022/0402020 A1 Dec. 22, 2022

Related U.S. Application Data

(60) Provisional application No. 63/244,958, filed on Sep. 16, 2021, provisional application No. 63/259,079, filed on Jun. 21, 2021.

(51) Int. Cl.
*B22D 17/26* (2006.01)
*B22D 17/32* (2006.01)

(52) U.S. Cl.
CPC ..... *B22D 17/26* (2013.01); *B22D 17/32* (2013.01)

(58) Field of Classification Search
CPC .... B22D 17/26; B22D 17/263; B22D 17/266; B22C 9/062; B29C 33/22; B29C 33/24
See application file for complete search history.

(56) References Cited

U.S. PATENT DOCUMENTS

| | | | | | |
|---|---|---|---|---|---|
| 2,319,479 | A | | 5/1943 | Ryder | |
| 2,848,771 | A | | 8/1958 | Eggenberger | |
| 3,195,186 | A | | 7/1965 | Gauban et al. | |
| 3,353,221 | A | * | 11/1967 | Barnett | B29C 45/641 249/165 |
| 4,184,835 | A | | 1/1980 | Talbot | |
| 4,372,738 | A | * | 2/1983 | Black | B29C 45/641 249/166 |
| 4,878,828 | A | * | 11/1989 | Wollschlager | B29C 45/1761 425/589 |

(Continued)

FOREIGN PATENT DOCUMENTS

| | | | | | |
|---|---|---|---|---|---|
| JP | 63042828 | A | * | 2/1988 | B29C 45/561 |
| JP | 05016191 | A | * | 1/1993 | B29C 45/641 |

OTHER PUBLICATIONS

Giga Press, The Future of Die Casting is Here Article, downloaded Jul. 12, 2022 (2 pages).

(Continued)

*Primary Examiner* — Kevin E Yoon
*Assistant Examiner* — Jacky Yuen
(74) *Attorney, Agent, or Firm* — Calfee, Halter & Griswold LLP

(57) ABSTRACT

An exemplary die casting press includes a moveable platen that can be actuated to move toward and away from a fixed platen along tie bars. A fixed die is mounted on the fixed platen and a moveable die is mounted on the moveable platen. A die locking system has a locking post that is attached to and extends from the fixed die and a locking cam that is attached to the moveable die. An actuator moves the locking cam between a locked position and an unlocked position to engage and disengage from the locking post, respectively.

21 Claims, 15 Drawing Sheets

(56) References Cited

U.S. PATENT DOCUMENTS

| | | | | |
|---|---|---|---|---|
| 2003/0201576 | A1 | 10/2003 | Smith et al. | |
| 2019/0151939 | A1* | 5/2019 | Benck | B22D 17/26 |
| 2022/0080638 | A1* | 3/2022 | Iwaki | B29C 45/66 |

OTHER PUBLICATIONS

Visnic, Tesla Casts a New Strategy for Lightweight Structures, 2022 SAE International, Jun. 2, 2020 (3 pages).
European Search Report from EP Application 22180152.5, dated Nov. 17, 2022.
European Exam Report from EP Application 22180152.5, dated Oct. 6, 2023.

* cited by examiner

DIE LOCKING SYSTEM AND METHODS OF USING THE SAME

CROSS-REFERENCE TO RELATED APPLICATIONS

The present application claims the benefit of U.S. Provisional Application Ser. No. 63/244,958, filed on Sep. 16, 2021, entitled DIE LOCKING SYSTEM AND METHODS OF USING THE SAME, and U.S. Provisional Application Ser. No. 63/259,079, filed on Jun. 21, 2021, entitled HPDC-HIDC PARTING LINE SUPPLEMENTAL LOCKING SYSTEM, the entire disclosures of which are incorporated herein by reference in their entirety.

TECHNICAL FIELD

The present application relates generally to die casting, and more specifically to locking systems for die casting dies and methods of using the same.

BACKGROUND

Die casting is a molding process that can produce a formed part in many different ways, such as, for example, low pressure die casting, high pressure die casting, and high integrity die casting. Die casting typically involves closing two halves of a mold to enclose a mold cavity into which a molten casting material is introduced. The casting material flows into and fills the mold cavity and then is allowed to cool and solidify into the desired part. After an appropriate cooling time, the mold is opened and the formed part can be removed.

Low pressure die casting uses lower injection pressures to produce high dimensionally accurate parts with minimal internal porosity. This process involves introducing a molten alloy into a mold—typically a mold held in a vertical orientation—under low velocity and pressure to minimize turbulence and trapped air to produce a high-density part. Process cycle times for low pressure die casting are long (e.g., 4-10 minutes) to allow for cooling of the part. The wall thickness of the formed part is typically greater than 3 millimeters, resulting in a heavy cast part. The initial capital investments are lower for low pressure die casting when compared to high pressure die casting.

High pressure die casting uses a high injection pressure in the molten casting media so that molds can be used to produce a thinner walled part at a greater speed than low pressure casting. The high pressure and high speed of the molten alloy injection is needed to ensure that the mold cavity is filled entirely by the molten material. The wall thickness of the parts formed by this process can be about 1 millimeter to about 3 millimeters. By virtue of the thinner wall thickness, the process cycle times are lower for high pressure die casting than low pressure die casting. The size of parts formed by high pressure die casting is limited by the pressure that can be applied over the mold cavity by the die press; that is, a part cannot be formed in a press when the injection pressure applied to the area of the mold cavity would result in a force that is greater than the closing force applied to the mold to maintain the mold in the closed condition. If the maximum closing force of the die press is exceeded by the pressure of the molten casting media, the mold halves can be spread apart at the parting line (the border of the mold cavity) that can allow molten metal to "spit" out of the mold. The "spitting" molten metal not only results in non-conforming molded parts but tends to be very dangerous.

SUMMARY

An exemplary die casting press includes a moveable platen that can be actuated to move toward and away from a fixed platen along tie bars. A fixed die is mounted on the fixed platen and a moveable die is mounted on the moveable platen. A die locking system has a locking post that is attached to and extends from the fixed die and a locking cam that is attached to the moveable die. An actuator moves the locking cam between a locked position and an unlocked position to engage and disengage from the locking post, respectively.

An exemplary die locking system includes a locking post, a locking cam, and an actuator for moving the locking cam between a locked position and an unlocked position. In the locked position, the locking cam engages the locking post. In the unlocked position, the locking cam is disengaged from the locking post.

An exemplary method of die casting includes steps of: closing a moveable die against a fixed die to form a mold cavity; locking a die locking system; and injecting molten casting media into the mold cavity. The die locking system is attached to the fixed die and to the movable die.

BRIEF DESCRIPTION OF THE DRAWINGS

To further clarify various aspects of embodiments of the present disclosure, a more particular description of the certain embodiments will be made by reference to various aspects of the appended drawings. It is appreciated that these drawings depict only typical embodiments of the present disclosure and are therefore not to be considered limiting of the scope of the disclosure. Moreover, while the figures can be drawn to scale for some embodiments, the figures are not necessarily drawn to scale for all embodiments. Embodiments and other features and advantages of the present disclosure will be described and explained with additional specificity and detail through the use of the accompanying drawings in which.

DETAILED DESCRIPTION

Figure 1:
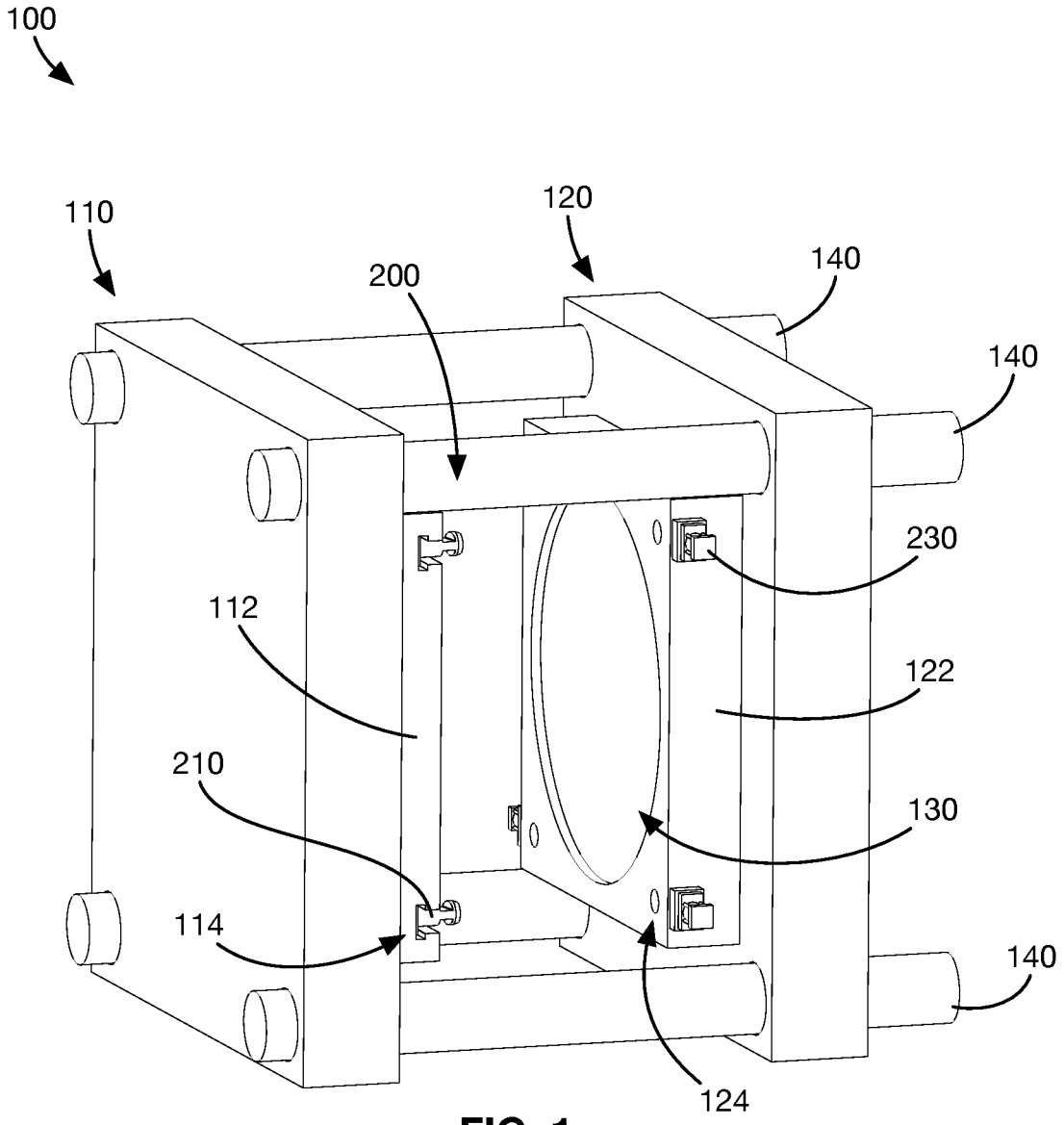
FIG. 1 is a perspective view of an exemplary die press in an open condition.
Figure 2:
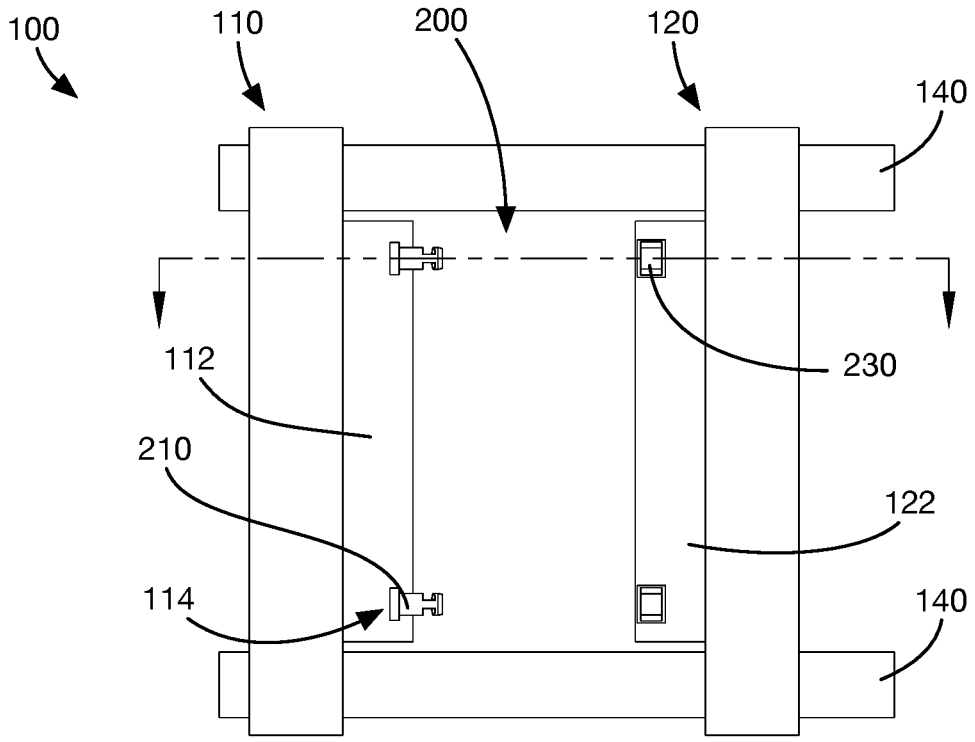
FIG. 2 is a side view thereof.
Figure 3:
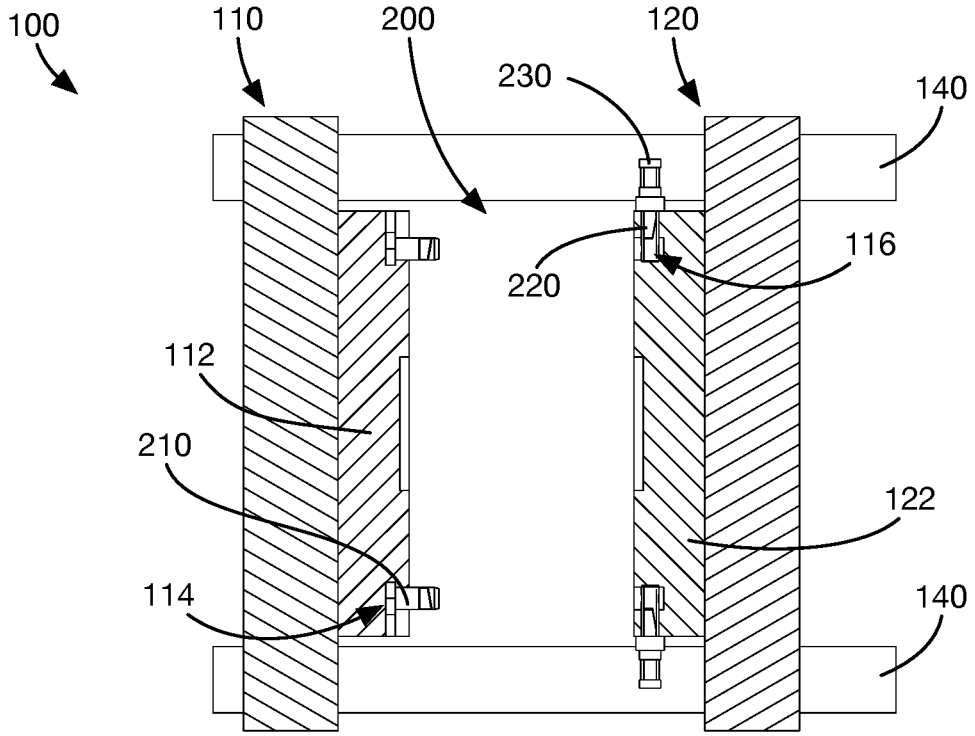
FIG. 3 is a cross-section view thereof, taken along the line 2-2 of FIG. 2.
Figure 4:
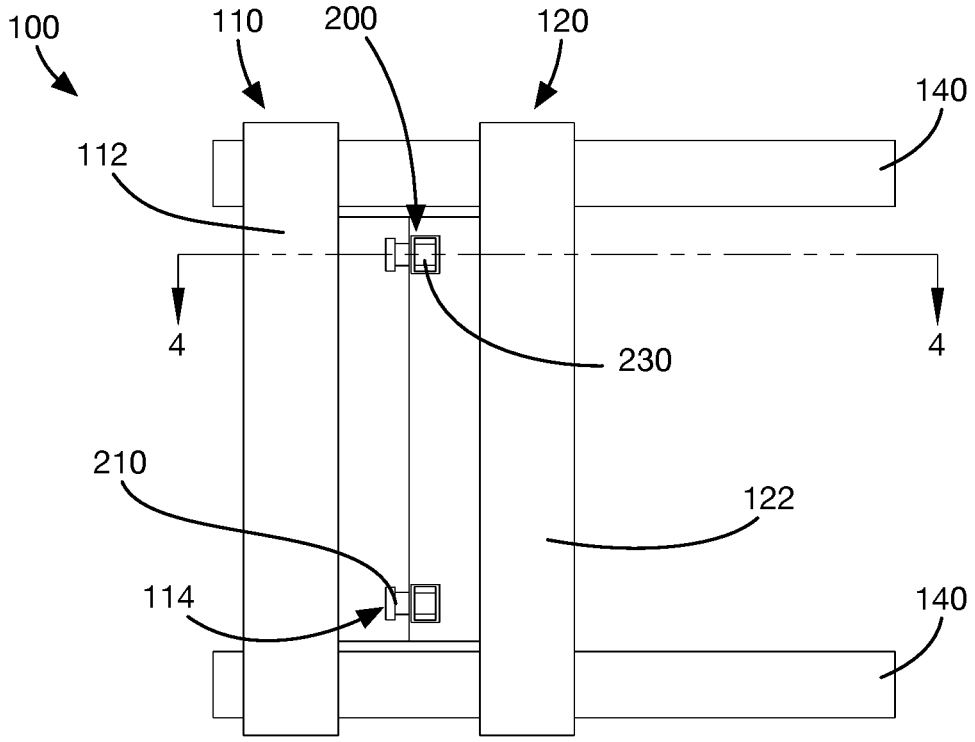
FIG. 4 is a side view of the exemplary die press of FIG. 1 with the press in a closed condition.

The following description refers to the accompanying drawings, which illustrate specific embodiments of the present disclosure. Other embodiments having different structures and operation do not depart from the scope of the present disclosure.

Exemplary embodiments of the present disclosure are directed to devices and methods for locking or clamping the multiple pieces of a casting die—e.g., male and female die halves—together. It should be noted that various embodiments of die locking systems are disclosed herein, and any combination of these options can be made unless specifically excluded. In other words, individual components of the disclosed devices and systems can be combined unless mutually exclusive or otherwise physically impossible.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

The present disclosure relates to die cast molding and, in particular, high pressure/high integrity die cast molding with, for example, molten aluminum or magnesium. The high pressure/high integrity die cast molding uses a die formed from two mold halves that are held together under high pressure under the injection of the molten metal. The molds or dies formed for high pressure and high integrity die casting are typically designed with a flat parting line—i.e., the portion of the mold at the perimeter of the mold cavity where the two mold halves or dies meet—to ensure a that the mold cavity is sufficiently sealed to prevent leakage of the molten casting media that can leak from the mold cavity and result in flashing along the parting line that must be removed after casting and/or spitting of molten media from the mold or die. An exemplary die casting system described herein includes a supplemental clamping or locking system that is incorporated into the die or die press to supply additional locking support in the closed condition of the mold during the die cast injection process. The additional locking or clamping force provided by the supplemental clamping or locking system reduces the likelihood of leakage at the parting line leading to flashing on the finished part or spitting during casting.

The molds or dies used in high pressure and high integrity die casting are sized according to the press that will be used to make the castings. In particular, the size of the die or mold is limited by the projected maximum footprint of the machine platens that the dies or molds attach to. The projected size of the casting is similarly limited. If a portion of the die or mold were to project outside of the platen surface, the injection pressure can exceed the clamping or closing pressure of the die so that the casting media leaks out and results in die cast parts with flashing along the parting line or that are otherwise non-conforming because of the loss of casting media at the parting line where the mold or die extended beyond the platen. Consequently, molds or dies for parts that are larger than the die press platens are not possible without the use of a larger machine. Larger machines may have long lead times and therefore might not be readily available for purchase and can also be cost prohibitive. The exemplary supplemental die clamping or locking system described herein enables larger molds to be used in a die casting system, thereby expanding the capabilities of existing die casting machines.

Existing die casting machines can be modified to incorporate the exemplary supplemental die locking or clamping systems described herein. Dies for die casting machines can also be created with the exemplary supplemental locking systems built-in or with features that facilitate the easy attachment of the exemplary systems described herein.

An exemplary die casting machine includes a stationary mold half or cover and a moveable mold half or ejector that can be moved by a suitable actuator to close against the stationary mold half or cover. An exemplary die locking system includes a locking post or pin attached to one mold or die half and a locking cam secured to the opposite mold or die half. The die locking system—i.e., the locking posts or pins, the locking cams, and actuators for actuating the locking cams—can be removably attached to the dies or molds such that the same die locking system can be used across a wide variety of dies or molds. The attachment of the locking posts or pins, the locking cams, and actuators can be attached to a die or mold half via a quick-change system to facilitate easy removal and replacement of these components. While the exemplary die locking systems disclosed herein can be used on a wide variety of molds or dies, the components of the die locking system can also be sized for a particular mold or die based on the mold or die size and the supplemental forces required.

When the die halves are closed together, the locking cam is actuated to engage the locking post or pin, thereby mechanically locking the two die halves together. The engagement surfaces of the locking post or pin and the locking cam can include a slope so that force applied to the locking cam is transformed into additional closing force via the locking post or pin. When the die locking system is locked, the pressure of the hydraulic actuator used to actuate the locking cams can be monitored to calculate the supplemental locking force transferred through the locking cams to the locking posts or pins. Thus, a control system for the die press and die locking system can measure and control the supplemental locking forces being applied to the die or mold halves via the die locking system. The control system can also consider the required clamping and locking forces and can prohibit operation of the die press if insufficient locking force is available from the installed die locking system—i.e., the control system can check whether a properly sized die locking system has been installed for the desired casting pressure and mold or die size.

Figure 5:
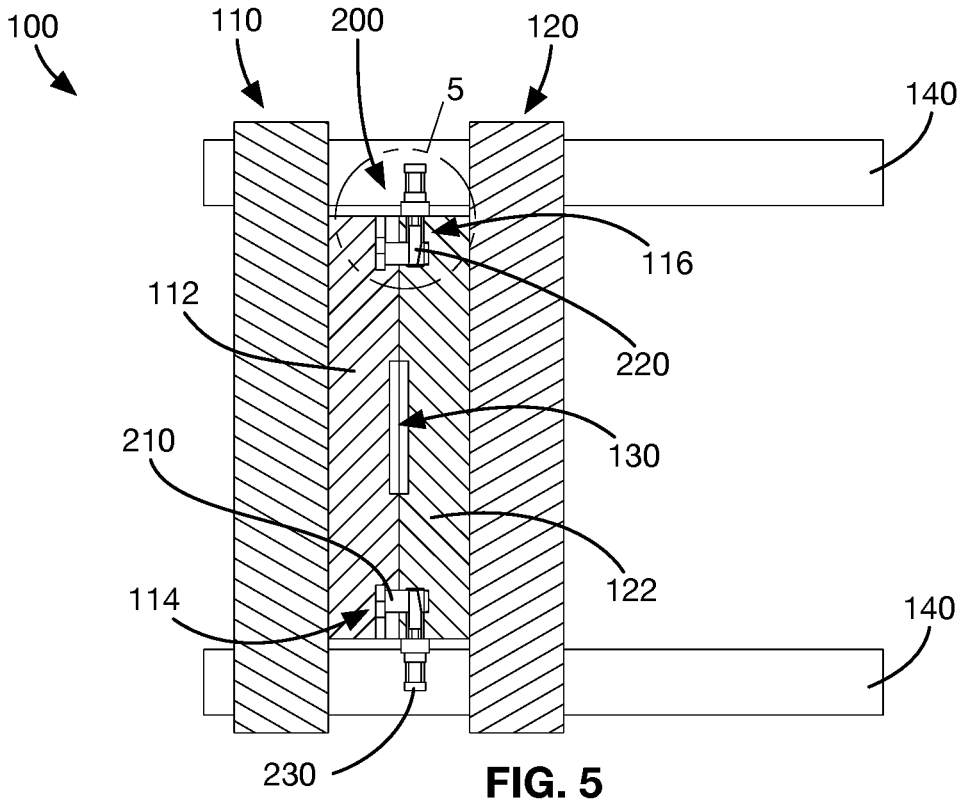
FIG. 5 is a cross-section view thereof, taken along the line 4-4 of FIG. 4.
Figure 6:
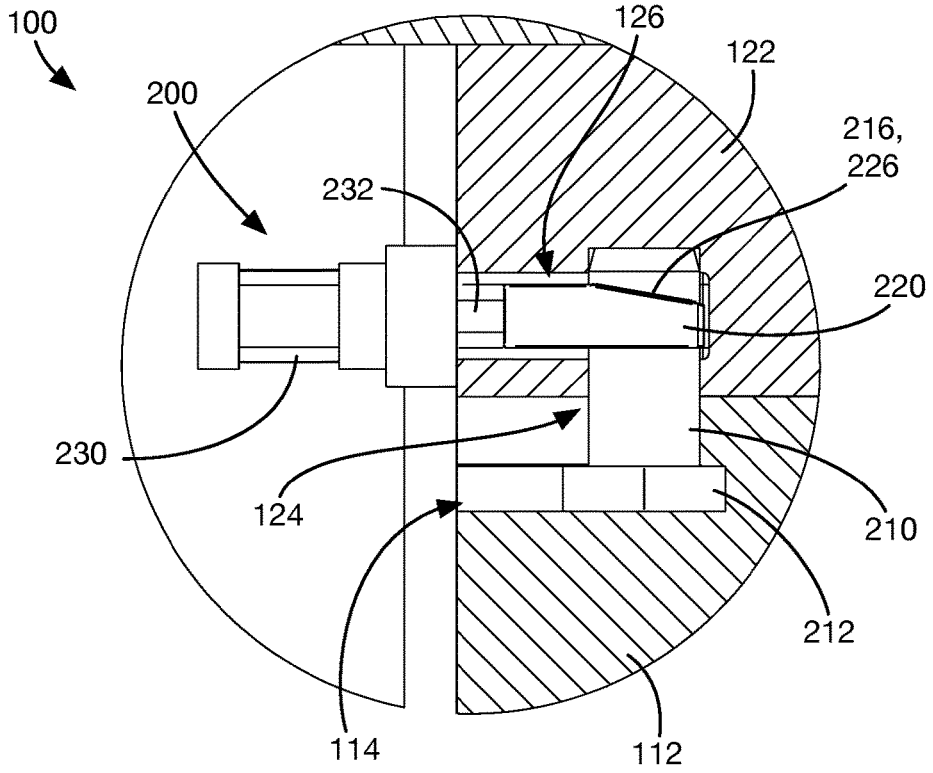
FIG. 6 is an enlarged detail view of area 5 of FIG. 5.
Figure 7:
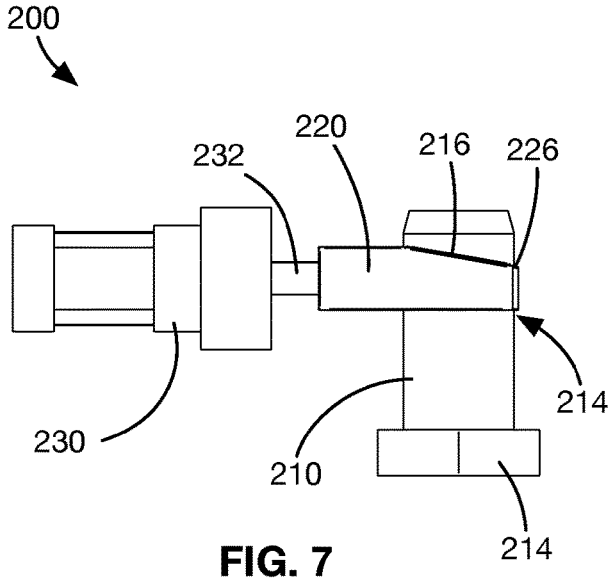
FIG. 7 is a side view of an exemplary locking mechanism in a closed or locked condition.
Figure 8:
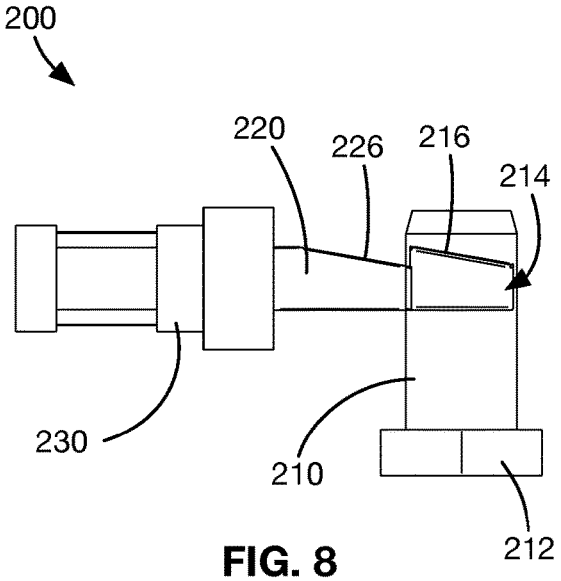
FIG. 8 is a side view of thereof in an open or unlocked condition.

Referring now to FIGS. 1-20, an exemplary die press 100 that includes an exemplary die locking system 200 is shown. The die press 100 includes a fixed or stationary platen 110 and a moveable platen 120. A fixed or stationary die 112 is attached to the fixed platen 110 and a moveable die 122 is attached to the moveable platen 120. As is well known in the art, the fixed or stationary die 112 can also be described as a cover and the moveable die 122 can also be described as an ejector. The moveable platen 120 is moved towards and away from the fixed platen 110 by a main actuator (not shown) to close and open the moveable die 122 and to provide a clamping or closing force between the moveable die 122 and the fixed die 112 in the closed condition. In the closed condition, the fixed die 112 and the movable die 122 enclose a mold cavity 130 (FIG. 5). The main actuator used to move the movable platen 120 can be any suitable actuator or plurality of actuators, such as, for example, a hydraulic actuator, a mechanical actuator, an electromagnetic actuator, or the like. As is described above, the maximum clamping or closing force applied by the main actuator is typically used in the industry to differentiate one die press from another—e.g., a 500 ton die press and a 3,500 ton die press.

During a die casting operation, pressurized molten casting media, such as, for example, molten aluminum or molten magnesium, is injected into and fills the mold cavity 130 at an injection pressure to form the desired die cast part. A parting line 132 (FIG. 18) is formed at the perimeter of the mold cavity 130 where the fixed die 112 and the moveable die 122 meet. Clamping pressure from the main actuator and the die locking system 200 prohibits leakage of casting media from the mold cavity 130 at the parting line 132 when the moveable die 122 is closed against the fixed die 112.

The moveable platen 120 is moved by the main actuator toward and away from the fixed or stationary platen 110 along a plurality of tie bars 140. The main actuator applies a force between a portion of the tie bars 140 and the moveable platen 120 to cause the moveable platen 120 to move along the tie bars 140 until the moveable die 122 closes against the fixed die 112. The fixed die 112 and the moveable die 122 are supported by a bottom frame (not shown) that supports and aligns the fixed die 112 and the moveable die 122. Guide pins in the fixed die 112 and the moveable die 122 maintain alignment between the fixed die 112 and the moveable die 122 when the die press 100 is closed. During casting, the main actuator closes the moveable die 122 against the fixed die 112 and applies pressure to the moveable die 122 to ensure that the moveable die 122 and fixed die 112 do not separate when the mold cavity 130 is filled with pressurized molten casting media. An exemplary die locking system 200 can be included in the fixed die 112 and the moveable die 122 to provide a supplemental locking force that helps the main actuator hold the moveable die 122 against the fixed die 112 during casting. In this way, the die locking system 200 can increase the maximum closing force or capacity of the die press 100.

The die locking system 200 includes a locking pin 210 attached to the fixed die 112 and a locking cam 220 attached to the moveable die 122. T-shaped slots 114 in the fixed die 112 receive and retain the locking pins 210. When the moveable die 122 is closed against the fixed die 112, the locking pins 210 extend through holes 124 of the moveable die 122 where the locking pins 210 are engaged by the locking cams 220. The locking pins 210 can be removably attached to the fixed die 112 via the slots 114 or can be attached permanently to the fixed die 112 via welding or by being integrally formed with the fixed die 112. The locking cams 220 extend through actuator openings 126 in the sides of the moveable die 122 and are moved in and out of engagement with the locking pins 210 by hydraulic actuators 230 that are attached to the sides of the moveable die 122.

The die locking system 200 can be added to any suitable die casting system by machining the slots 114 into the fixed die 112 and the holes 124 and openings 126 in the moveable die 122. The opposite can also be done, with the slots 114 being formed in the moveable die 122 and the holes 124 and openings 126 being formed in the fixed die 112. A mixture of both arrangements is also possible, with corresponding slots 114, holes 124, and openings 126 being formed in both the fixed die 112 and the moveable die 122.

Figure 9:
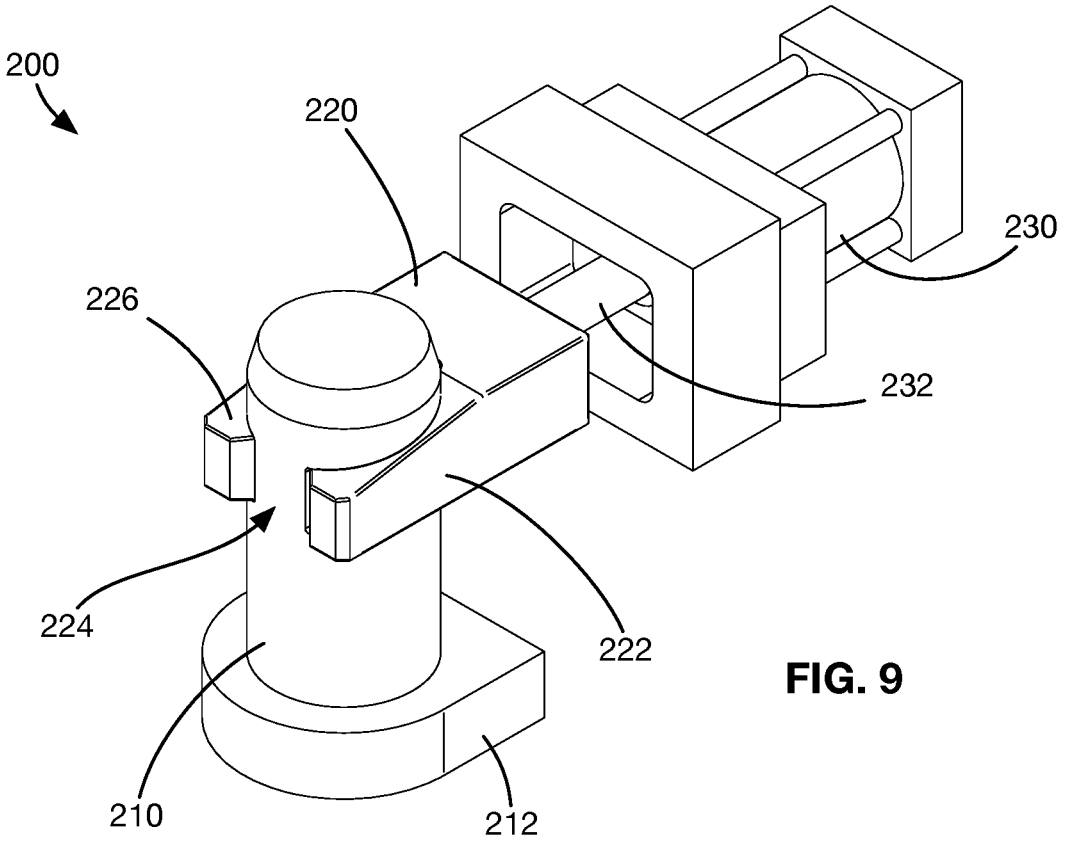
FIG. 9 is a perspective view of the exemplary locking mechanism of FIG. 7.
Figure 10:
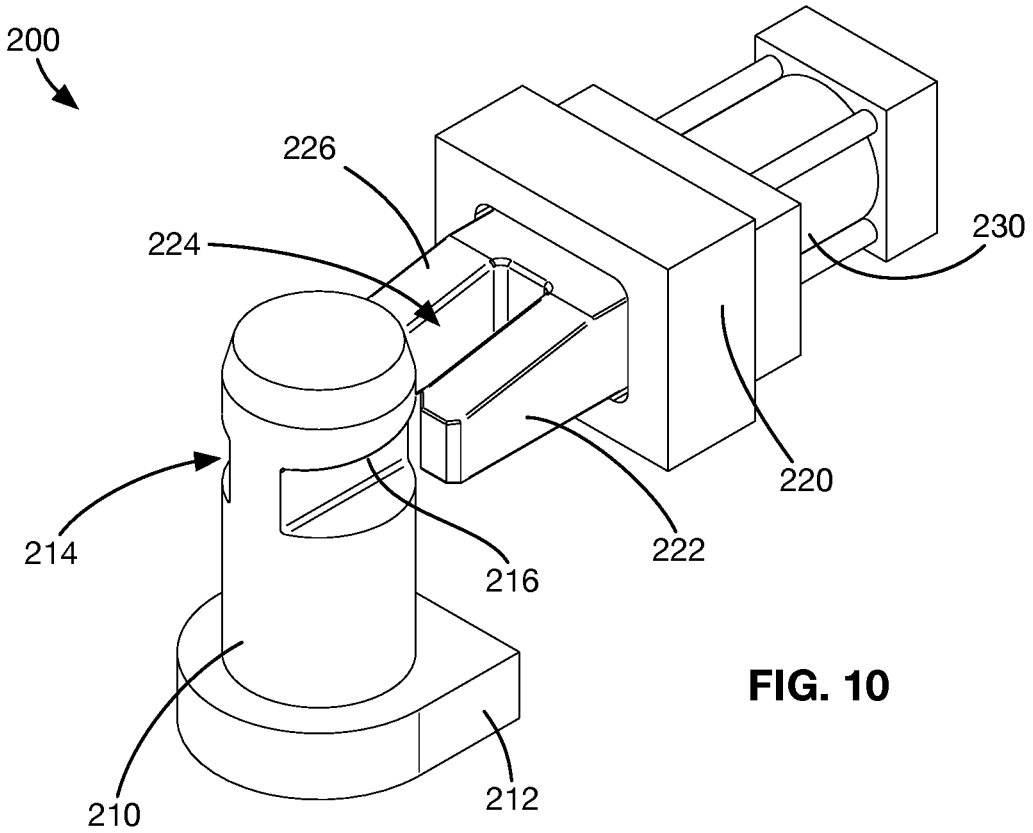
FIG. 10 is a perspective view of the exemplary locking mechanism of FIG. 8.
Figure 11:
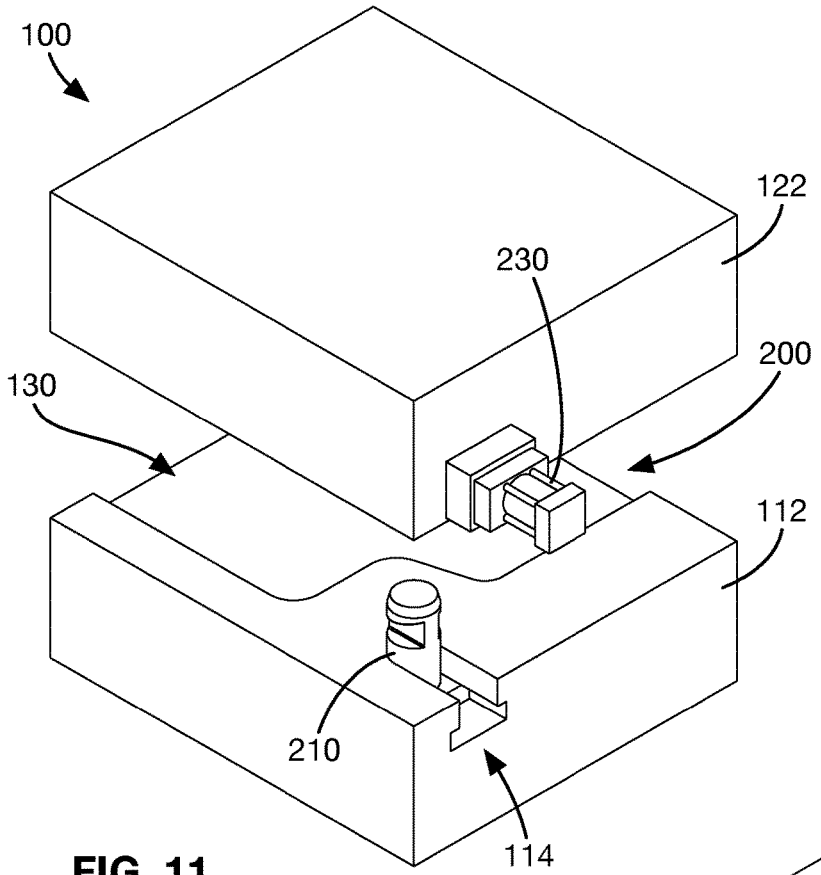
FIG. 11 is a top perspective view of a portion of an exemplary die locking system with the die in an open condition.
Figure 12:
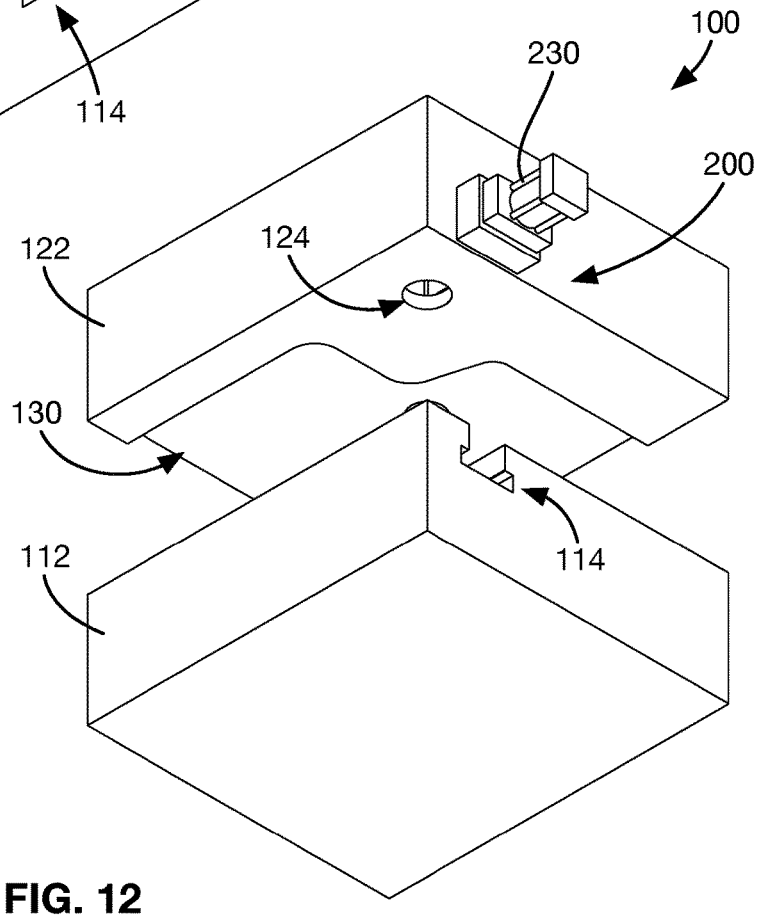
FIG. 12 is a bottom perspective thereof.
Figure 13:
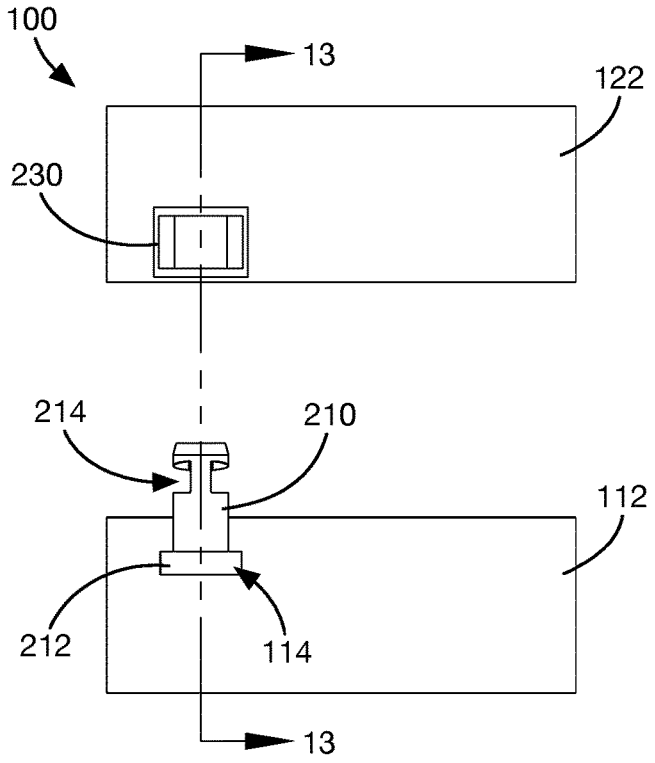
FIG. 13 is a front view thereof.
Figure 14:
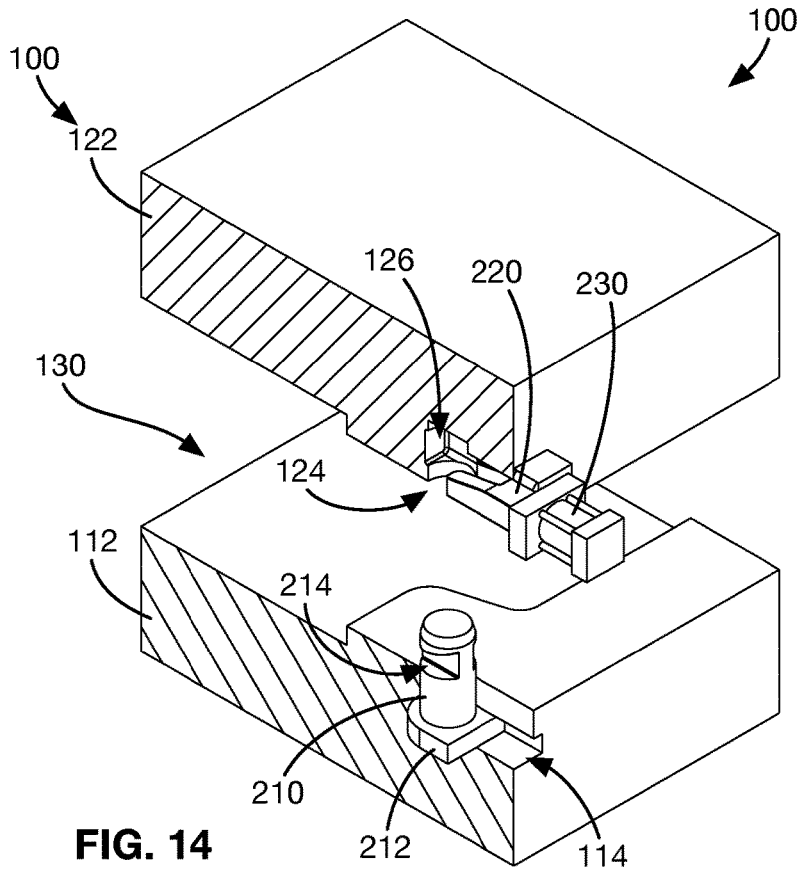
FIG. 14 is a perspective view of a cross-section thereof, taken along the line 13-13 of FIG. 13.
Figure 15:
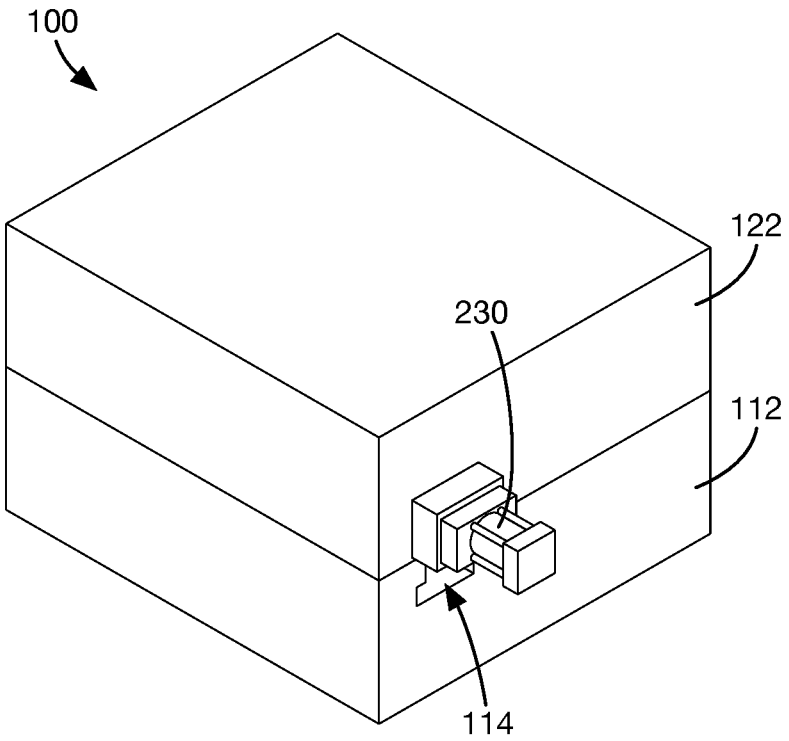
FIG. 15 is a top perspective view of a portion of an exemplary die locking system with the die in an open condition.
Figure 16:
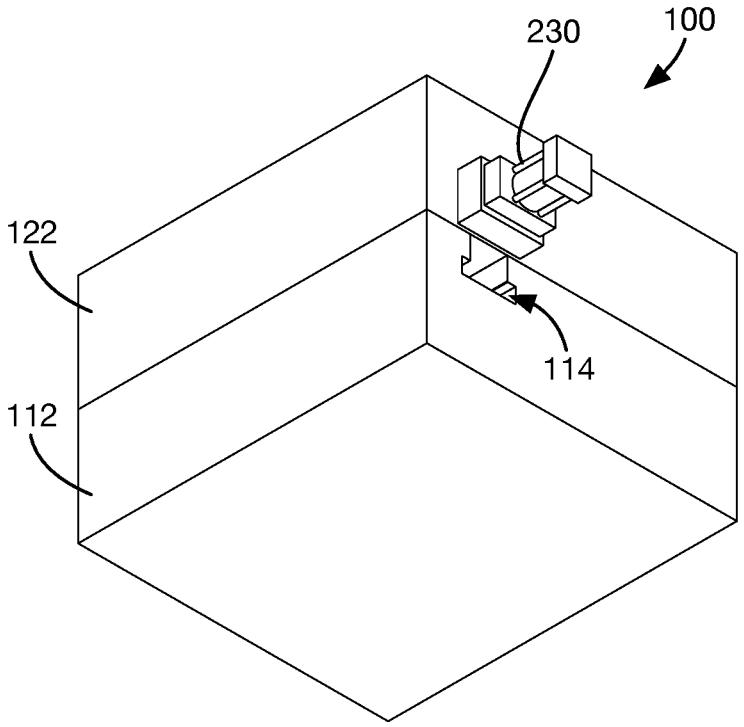
FIG. 16 is a bottom perspective thereof.
Figure 17:
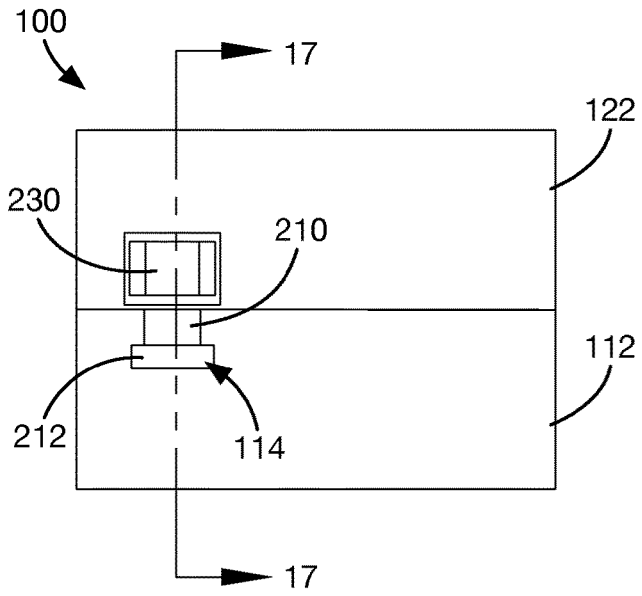
FIG. 17 is a front view thereof.
Figure 18:
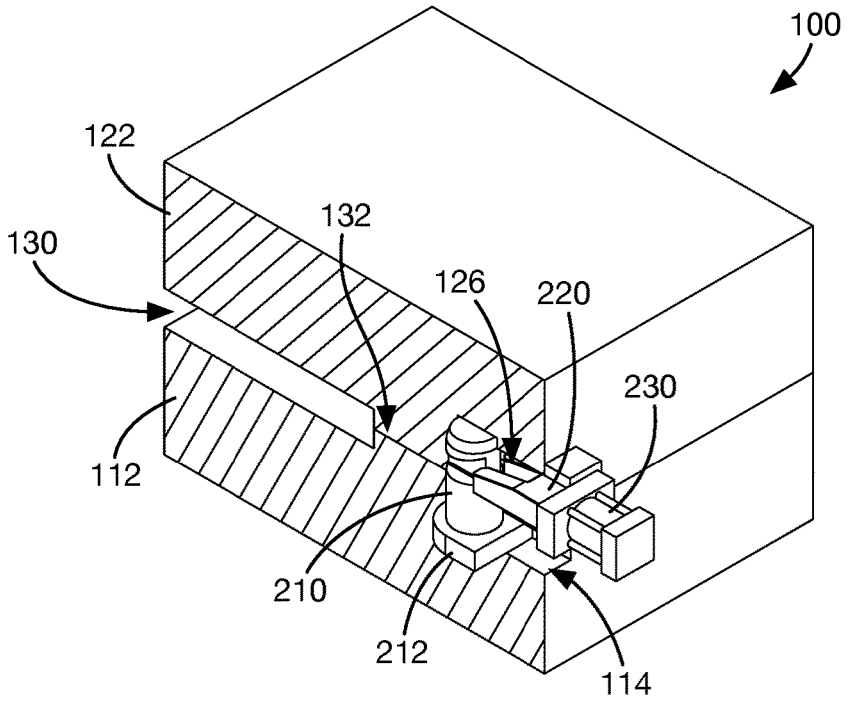
FIG. 18 is a perspective view of a cross-section thereof, taken along the line 17-17 of FIG. 17 and showing the die locking system in an unlocked condition.
Figure 19:
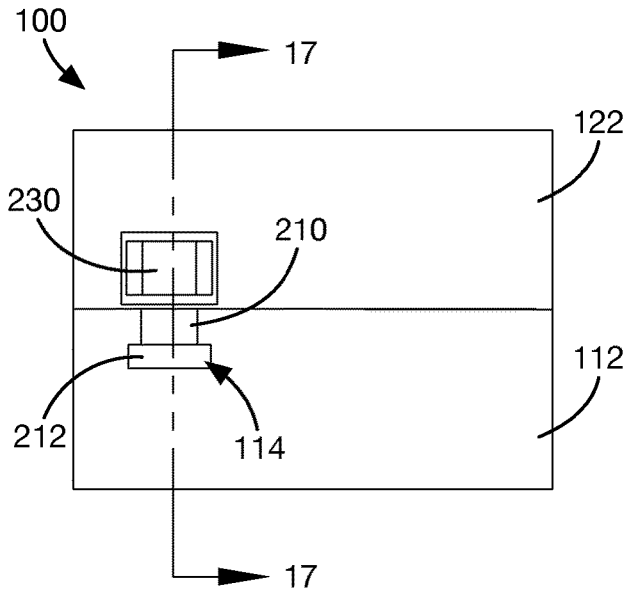
FIG. 19 is a front view of the exemplary die locking system of FIG. 15 with the die locking system in a locked condition.
Figure 20:
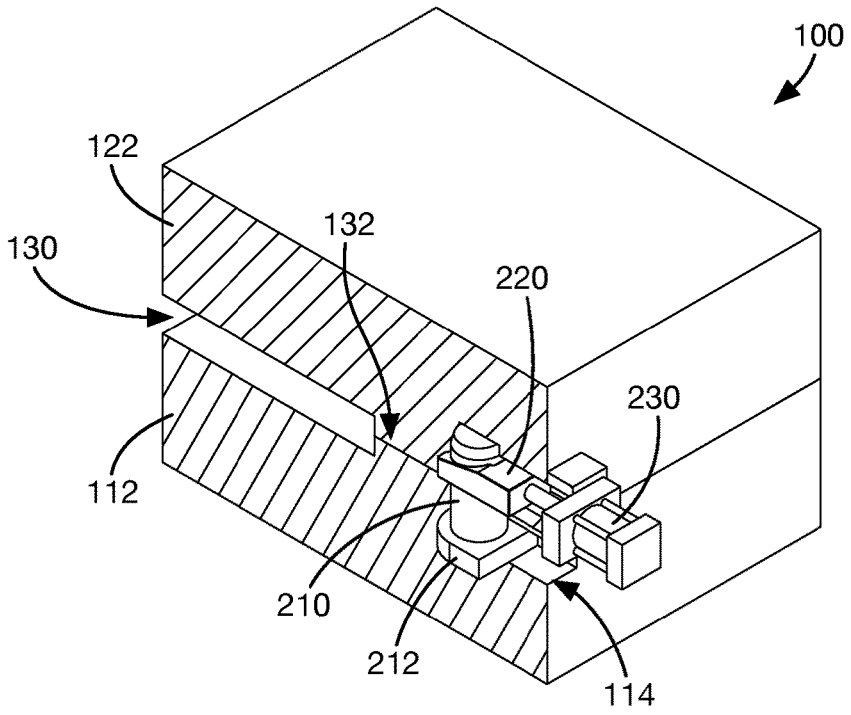
FIG. 20 is a perspective view of a cross-section thereof, taken along the line 19-19 of FIG. 19.

Referring now to FIGS. 9 and 10, the die locking system 200 is shown separate from the die press 100 in a locked or closed condition (FIG. 9) and an unlocked or open condition (FIG. 10). The die locking system 200 includes the locking post or pin 210 that includes a flange 212 for engaging the corresponding slot 114 of the fixed die 112. Locking grooves or notches 214 in the locking post or pin 210 are shaped to engage with the locking cam 220. The locking cam 220 includes fingers or protrusions 222 spaced apart by a gap 224, the protrusions 222 being shaped to engage the locking grooves 214 of the locking post 210. An inclined surface 216 of the locking groove 214 corresponds to an inclined surface or ramp 226 of the protrusions 222. The locking cam 220 is moved from an unlocked or open condition (FIGS. 8 and 10) into engagement with the locking post 210 in a locked or closed condition (FIGS. 7 and 9) by the actuator 230 that includes a shaft 232 for attaching the locking cam 220 to the actuator 230.

Referring now to FIGS. 11-20, a section of the die press 100 including one die locking system 200 is shown to illustrate the steps of closing the die press 100 and locking the die locking system 200. When the die is in the open condition (FIGS. 11-14), the locking cam 220 is also moved into the unlocked or open condition (FIG. 14) to prepare for closing the moveable die 122 against the fixed die 112. In the closed condition (FIGS. 15-20) the locking cam 220 is moved from the open or unlocked condition (FIG. 18) to the closed or locked condition (FIG. 20) by the actuator 130 extending the actuator shaft 132.

Figure 21:
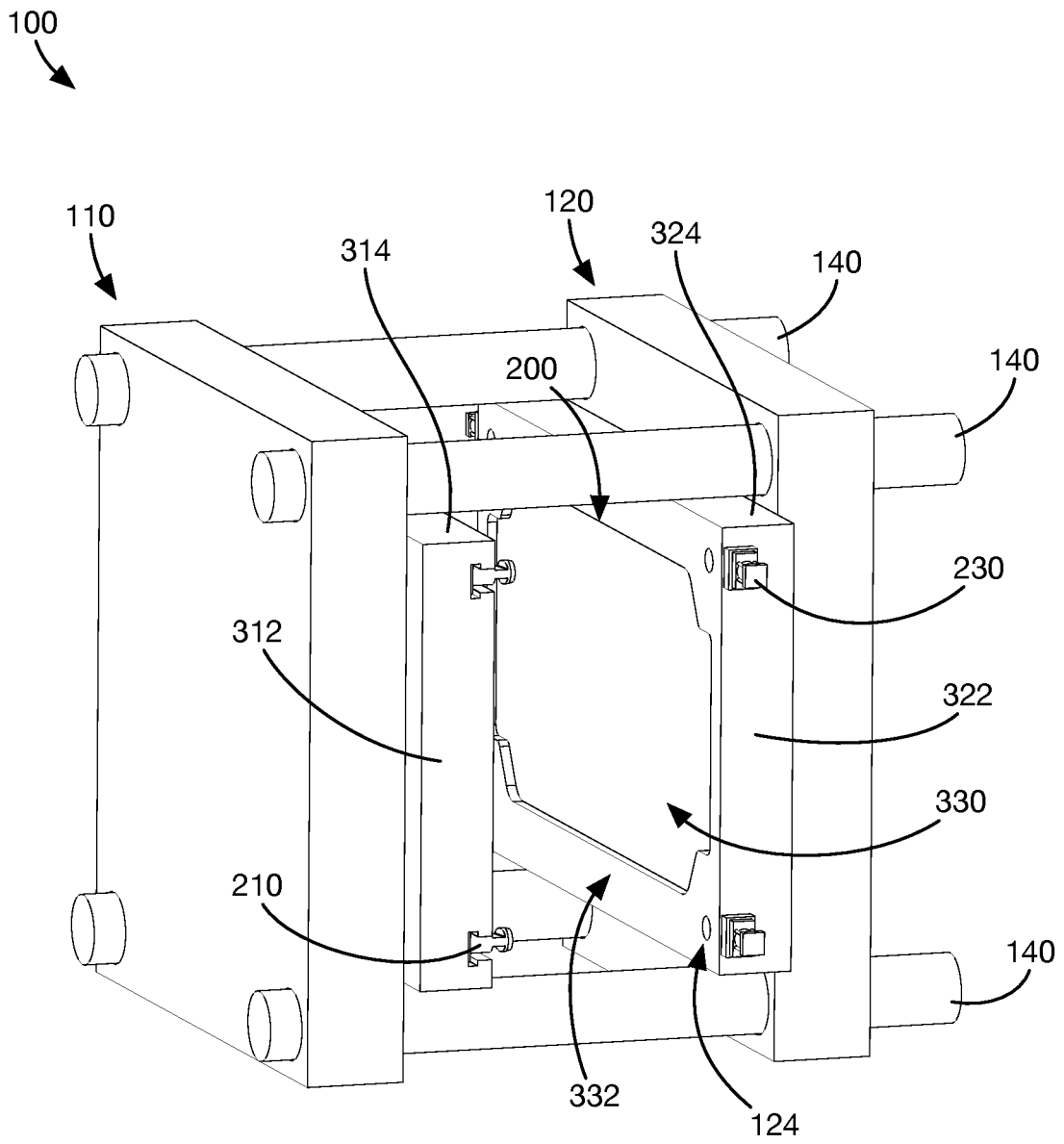
FIG. 21 is a perspective view of an exemplary die press in an open condition.
Figure 22:
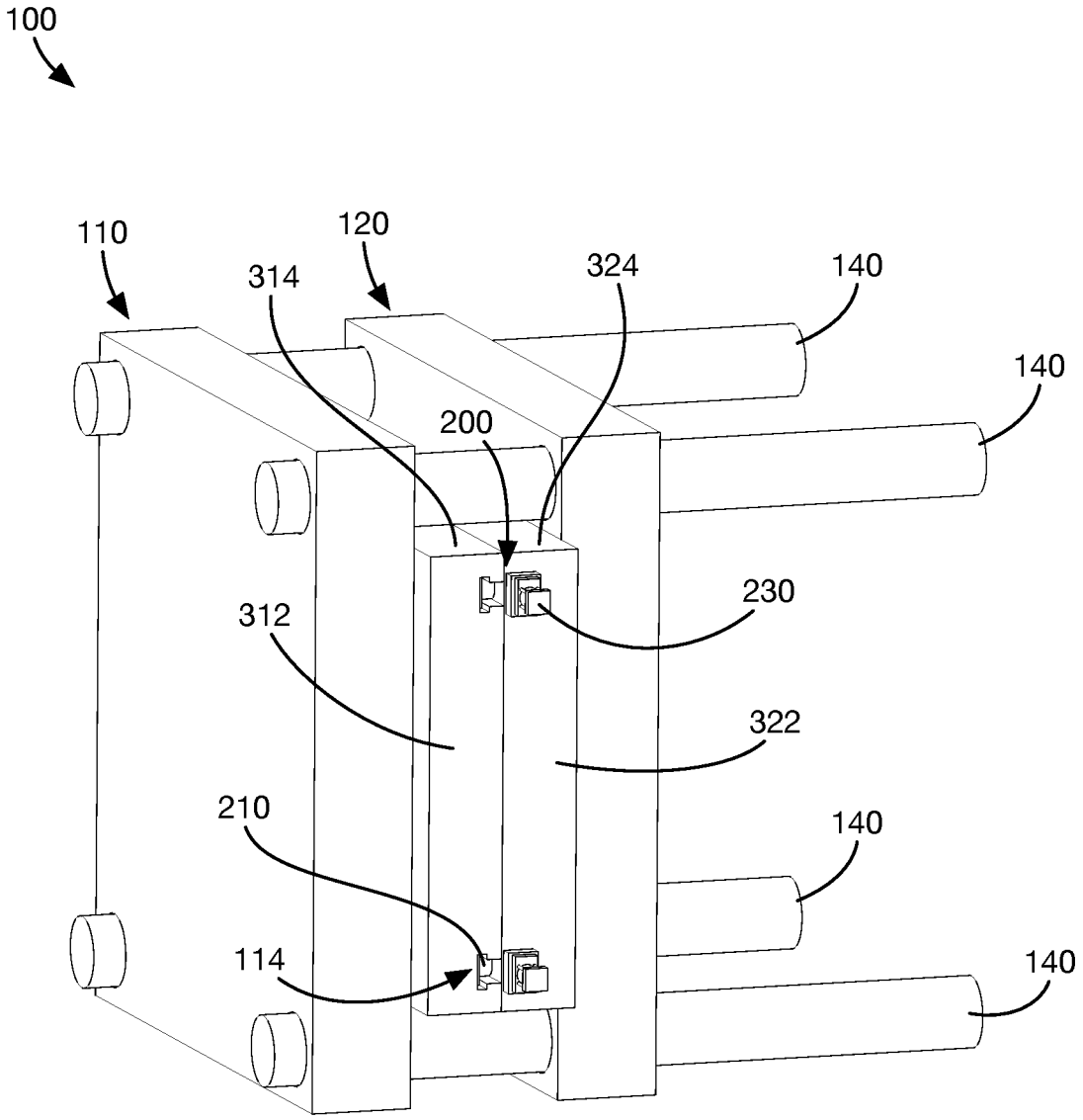
FIG. 22 is a perspective view of the exemplary die press of FIG. 21 in a closed condition.

Referring now to FIGS. 21 and 22, the exemplary die press 100 is shown with a fixed die 312 and a moveable die 322. The fixed or stationary die 312 is attached to the fixed platen 110 and the moveable die 322 is attached to the moveable platen 120. The moveable platen 120 is moved towards and away from the fixed platen 110 by a main actuator (not shown) to close and open the moveable die 322 and to provide a clamping or closing force between the moveable die 322 and the fixed die 312 in the closed condition. In the closed condition, the fixed die 312 and the movable die 322 enclose a mold cavity (half of which is visible in FIG. 21). The main actuator used to move the movable platen 120 can be any suitable actuator or plurality of actuators, such as, for example, a hydraulic actuator, a mechanical actuator, an electromagnetic actuator, or the like.

The fixed die 312 and the moveable die 322 include corresponding ends 314, 324 that extend beyond the projected area of the fixed and moveable platens 110, 120. The clamping or closing force of the main actuator is applied to the fixed die 312 and the movable die 322 within the projected area of the fixed platen 110 and the moveable platen 120. As the ends 314, 324 of the fixed and moveable dies 312, 322 extend further from the projected area of the fixed and moveable platens 110, 120 the likelihood of the parting line will separate when subjected to casting pressures increase. The ends 314, 324 of the fixed and moveable dies 312, 322 can be pressed together by the die locking systems described herein, such as, for example, the die locking system 200 described above to reduce the likelihood of separation at the parting line at the ends 314, 324.

During a die casting operation, pressurized molten casting media, such as, for example, molten aluminum or molten magnesium, is injected into and fills the mold cavity 330 at an injection pressure to form the desired die cast part. A parting line 332 is formed at the perimeter of the mold cavity 330 where the fixed die 312 and the moveable die 322 meet. The die locking system 200 can be attached to the ends 314, 324 of the fixed and moveable dies 312, 322 to provide additional clamping or closing force so that the entirety of the fixed and moveable dies 312, 322 are pressed together with sufficient force to resist the injection pressure of the molten casting media. Clamping pressure from the main actuator and the die locking system 200 prohibits leakage of casting media from the mold cavity 330 at the parting line 332 when the moveable die 322 is closed against the fixed die 312. Thus, the maximum effective clamping force of the die press 100—i.e., the pressure that the die press is capable of applying across the entirety of the projected surface of the fixed and moveable dies— can be increased by the addition of the die locking system 200.

Figure 23:
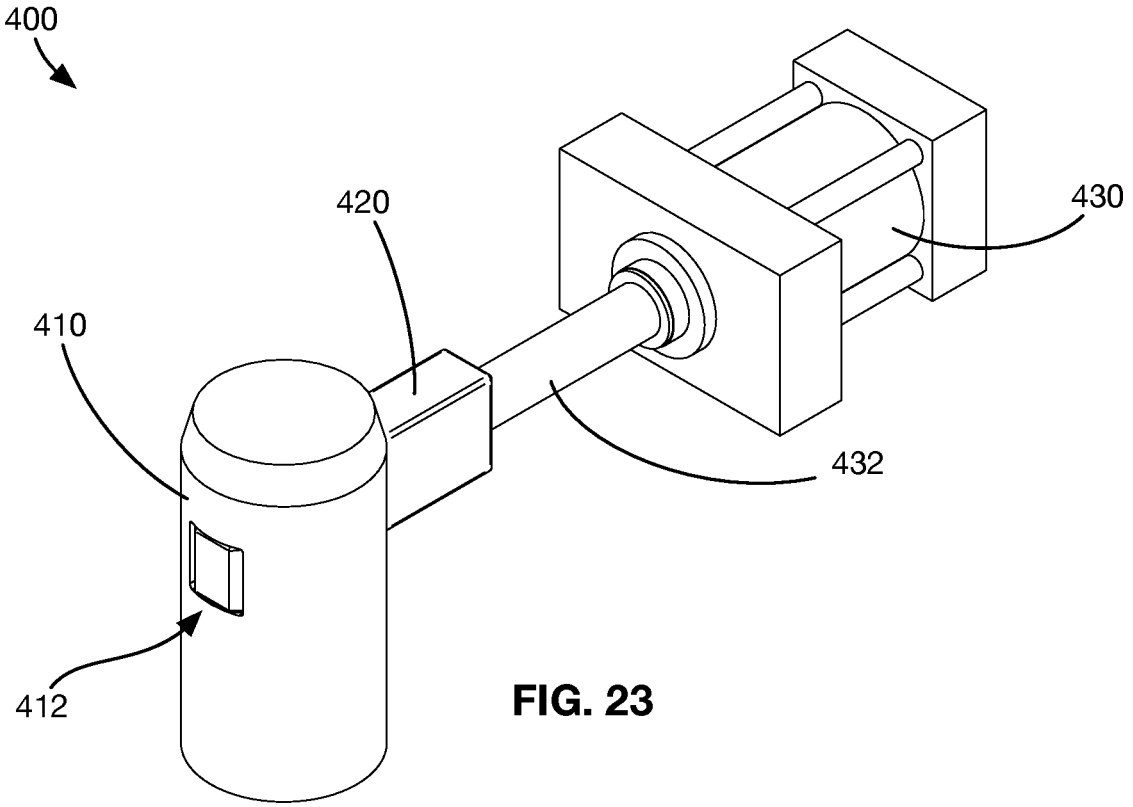
FIG. 23 is a perspective view of an exemplary locking mechanism in a closed or locked condition.
Figure 24:
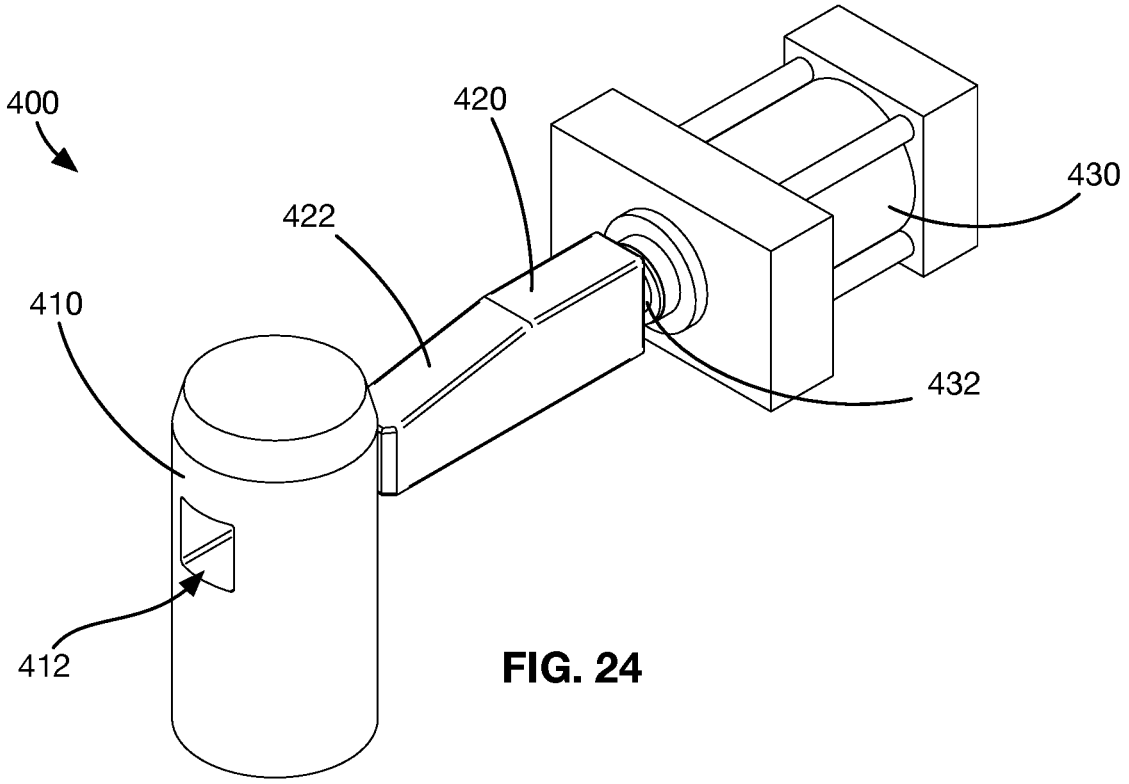
FIG. 24 is a perspective view of the exemplary locking mechanism of FIG. 23 in an open or unlocked condition.

Referring now to FIGS. 23-26, exemplary die locking systems 400, 500 are shown with different configurations for the locking cam than the die locking system 200 described above. Both of the die locking systems 400, 500 are shown separate from the die press 100 and in a locked or closed condition (FIGS. 23 and 25) and in an unlocked or open condition (FIGS. 22 and 24).

Referring now to FIGS. 23 and 24, a die locking system 400 is shown that has a single locking cam for fitting in an opening of a locking post. The die locking system 400 can be used with any die and die press described herein. The die locking system 400 includes the locking post or pin 410 that can include a flange or other feature (not shown) for engaging a corresponding slot 114 of the fixed die 112. A single opening slot 412 in the locking post or pin 410 is shaped to engage with a locking cam 420. The locking cam 420 includes an inclined surface 422 shaped to engage a corresponding inclined surface (not shown) of the locking opening 412 of the locking post 410. The locking cam 420 is moved from an unlocked or open condition (FIG. 24) into engagement with the locking post 410 in a locked or closed condition (FIG. 23) by the actuator 430 that includes a shaft 432 for attaching the locking cam 420 to the actuator 430.

Figure 25:
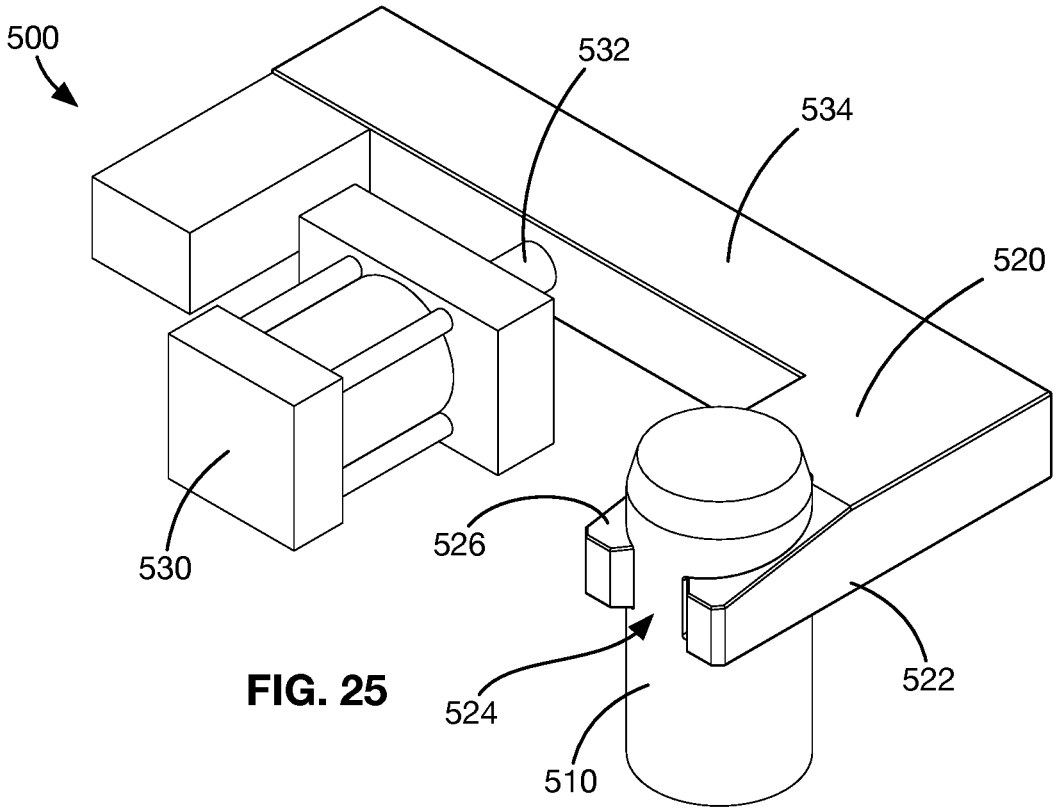
FIG. 25 is a perspective view of an exemplary locking mechanism in a closed or locked condition.
Figure 26:
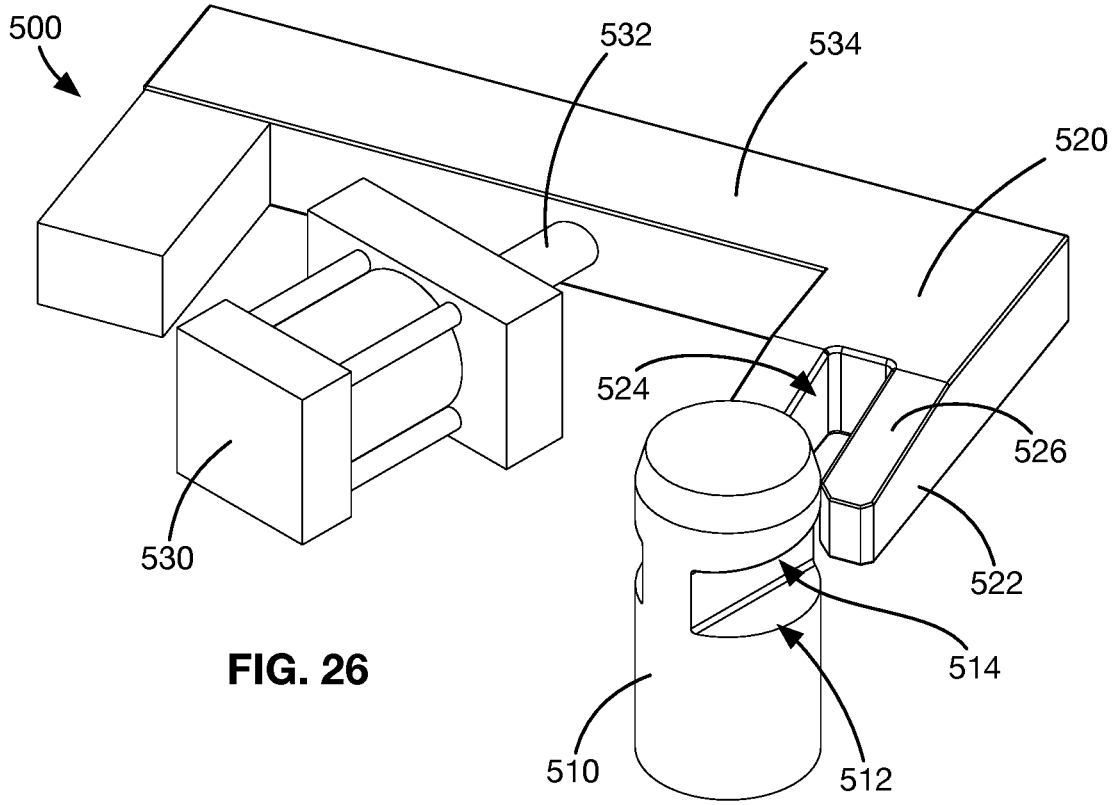
FIG. 26 is a perspective view of the exemplary locking mechanism of FIG. 25 in an open or unlocked condition.

Referring now to FIGS. 25 and 26, a die locking system 500 is shown that operates via a pivoting movement. The die locking system 500 can be used with any die and die press described herein. The die locking system 500 includes the locking post or pin 510 that can include a flange or other feature (not shown) for engaging a corresponding slot 114 of the fixed die 112. Locking grooves or notches 512 in the locking post or pin 510 are shaped to engage with the locking cam 520. The locking cam 520 includes fingers or protrusions 522 spaced apart by a gap 524, the protrusions 522 being shaped to engage the locking grooves 512 of the locking post 510. An inclined surface 514 of the locking groove 512 corresponds to an inclined surface or ramp 526 of the protrusions 522. The locking cam 520 is moved from an unlocked or open condition (FIG. 26) into engagement with the locking post 510 in a locked or closed condition (FIG. 25) by the actuator 530. The locking cam 520 is attached to a pivoting linkage 534 that enables the locking cam 520 to pivot between the locked and unlocked condition. The actuator 530 includes a shaft 532 that is attached to the pivoting linkage 534 to facilitate pivoting the locking cam 520 between the locked and unlocked positions.

Figure 27:
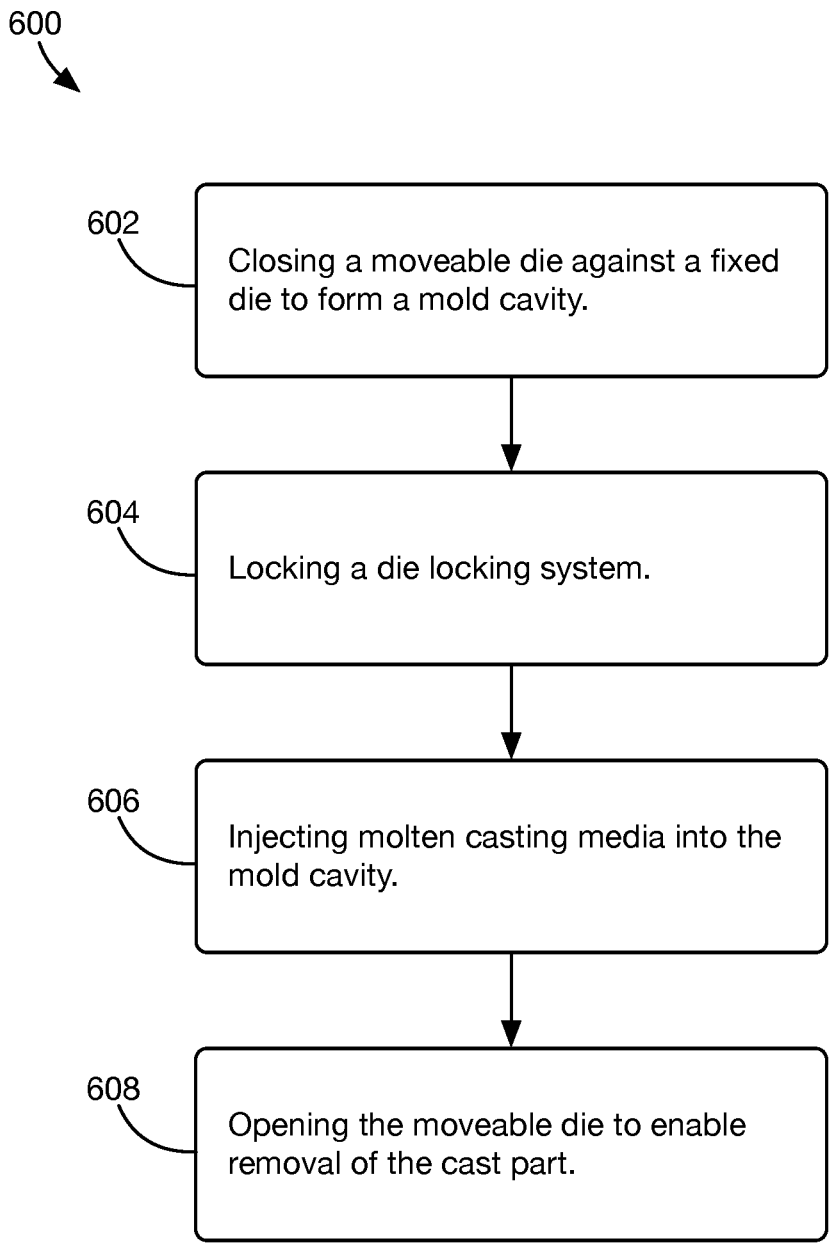
FIG. 27 is a flow chart indicating the steps for closing and locking an exemplary die press having an exemplary die locking mechanism.

Referring now to FIG. 27, a flow chart diagramming an exemplary process 600 for high pressure and high integrity die casting with the die press and die locking systems described herein is shown. The moveable die is closed against the fixed die in step 602 to form a mold cavity. Clamping or closing force between the dies is applied by the main actuator to a desired clamping or closing force or pressure to ensure that the dies remain closed together during the casting operation. That is, the closing or clamping force is calculated to exceed the force generated by the pressure of the molten casting media applied to the surface of the mold cavity. In step 604 the die locking system or systems attached to the dies are actuated to lock the fixed and moveable dies together. The actuation of the die locking system can end after a predetermined distance has been traveled by the locking cams or when a predetermined actuation pressure—an indicator of a locking force applied by the lock—has been reached. An optional step of monitoring the clamping or closing pressure of the main actuator or die locking systems can be performed at any time in the die casting process 600. For example, the clamping or closing force of the main actuator and die locking systems can be increased to maintain a safety margin above the force generated by the injection of pressurized molten casting media. Once the dies are closed and the die locking system is locked, in step 606 the molten casting media can be injected into the mold cavity. The die press is then allowed to cool for a cooling time that varies depending on at least the casting alloy, size, shape, and thickness of the cast part. In step 608 the dies are opened to allow removal of the cast part.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on— may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A die casting press comprising:
a fixed platen;
a moveable platen moveably connected to the fixed platen via a plurality of tie bars;
an actuator for moving the moveable platen toward and away from the fixed platen;
a fixed die mounted on the fixed platen;
a moveable die mounted on the moveable platen;
a die locking system attached to the fixed die and the moveable die, the die locking system comprising:
a fixed locking post attached to and extending from the fixed die, wherein the fixed locking post is attached to the fixed die between a side of the fixed die and a parting line formed at a perimeter of a mold cavity enclosed by the fixed die and the moveable die when the moveable die is in a closed condition;
an actuator attached to the movable die, the actuator comprising an extendable shaft;
a moveable locking cam attached to the extendable shaft of the actuator;
wherein the actuator extends the extendable shaft to move the moveable locking cam from an unlocked position wherein the moveable locking cam is disengaged from the fixed locking post to a locked position wherein the moveable locking cam engages the fixed locking post; and
wherein in the locked position, the actuator of the die locking system can be further actuated to provide additional locking force between the fixed die and the moveable die.

2. The die casting press of claim 1, wherein the moveable die comprises a hole for receiving the fixed locking post.

3. The die casting press of claim 2, wherein the moveable die comprises:
an opening that extends from a side of the moveable die to intersect the hole for receiving the fixed locking post;
wherein the moveable locking cam is arranged inside the opening; and
wherein the actuator is mounted on the side of the moveable die to move the moveable locking cam between the locked position and the unlocked position within the opening.

4. The die casting press of claim 1, wherein the fixed die and the moveable die each extend to an end located outside of a projected area of the fixed platen and the movable platen.

5. The die casting press of claim 1, wherein:
the fixed locking post comprises a flange;
the fixed die comprises a slot for receiving the fixed locking post and the flange, wherein the slot extends into the fixed die from the side of the fixed die.

6. The die casting press of claim 1, wherein:
the fixed locking post comprises a recess; and
the moveable locking cam comprises a protrusion for insertion into the recess of the locking post when the moveable locking cam is moved into the locked position.

7. The die casting press of claim 6, wherein the recess is a hole that extends through the fixed locking post.

8. The die casting press of claim 1, wherein in the locked position, a portion of the moveable locking cam extends beyond the fixed locking post.

9. The die casting press of claim 1, wherein the die locking system further comprises a linkage attached to the moveable locking cam so that the locking cam pivots toward and away from the fixed locking post when the actuator of the die locking system is actuated.

10. The die for a die casting press of claim 1, wherein the locking post is cylindrical and comprises a flange extending around a circumference of the locking post.

11. A die locking system comprising:
a fixed locking post, wherein the fixed locking post is cylindrical and comprises a flange extending around a circumference of the fixed locking post;
a movable locking cam; and
an actuator for moving the locking cam between a locked position wherein the locking cam engages the fixed locking post and an unlocked position wherein the locking cam is disengaged from the fixed locking post;
wherein in the locked position, the actuator can be further actuated to provide additional locking force between the fixed locking post and the locking cam.

12. The die locking system of claim 11, wherein:
the fixed locking post comprises a recess; and
the movable locking cam comprises a protrusion for insertion into the recess of the fixed locking post when the movable locking cam is moved into the locked position.

13. The die locking system of claim 12, wherein the recess is a hole that extends through the fixed locking post.

14. The die locking system of claim 11, wherein in the locked position, a portion of the movable locking cam extends beyond the fixed locking post.

15. The die locking system of claim 11, wherein the die locking system further comprises a linkage attached to the movable locking cam so that the movable locking cam pivots toward and away from the fixed locking post when the actuator is actuated.

16. A die for a die casting press, the die comprising:
a fixed die;
a moveable die;
a slot extending into one of the fixed die and the moveable die from a side of the one of the fixed die and the moveable die; and a die locking system attached to the fixed die and the moveable die, the die locking system comprising:

a fixed locking post attached to the slot and extending from one of the fixed die and the moveable die;

an actuator attached to the other of the fixed die and the movable die, the actuator comprising an extendable shaft;

a moveable locking cam attached to the extendable shaft of the actuator;

wherein the actuator extends the extendable shaft to move the movable locking cam from an unlocked position wherein the locking cam is disengaged from the fixed locking post to a locked position wherein the locking cam is engaged with the fixed locking post; and wherein in the locked position, the actuator of the die locking system can be further actuated to provide additional locking force between the fixed die and the moveable die.

17. The die for a die casting press of claim 16, wherein the other of the fixed die and the moveable die comprises a hole for receiving the locking post.

18. The die for a die casting press of claim 17, wherein the other of the fixed die and the moveable die comprises:

an opening that extends from a side of the other of the fixed die and the moveable die to intersect the hole for receiving the locking post;

wherein the locking cam is arranged inside the opening; and wherein the actuator is mounted on the side of the other of the fixed die and the moveable die to move the locking cam between the locked position and the unlocked position within the opening.

19. The die for a die casting press of claim 16, wherein:

the locking post comprises a recess; and the locking cam comprises a protrusion for insertion into the recess of the locking post when the locking cam is moved into the locked position.

20. The die for a die casting press of claim 16, wherein in the locked position, a portion of the locking cam extends beyond the locking post.

21. The die for a die casting press of claim 16, wherein the locking post is cylindrical and comprises a flange extending around a circumference of the locking post.

* * * * *